United States Patent [19]

Cross

[11] Patent Number: 4,838,612

[45] Date of Patent: Jun. 13, 1989

[54] OCCUPANT-ARISING ASSIST CHAIR

[75] Inventor: Michael G. Cross, Hornchurch, Great Britain

[73] Assignee: J. Cinnamon Limited, London, Great Britain

[21] Appl. No.: 225,082

[22] Filed: Jul. 26, 1988

[51] Int. Cl.[4] ..... A47C 1/02

[52] U.S. Cl. ..... 297/338; 297/DIG. 10; 297/313

[58] Field of Search ..... 297/DIG. 10, 338, 330, 297/304, 313

[56] References Cited

U.S. PATENT DOCUMENTS

| | | | |
|---|---|---|---|
| 3,479,086 | 11/1969 | Sheridan | 297/330 |
| 3,640,566 | 2/1972 | Hodge | 297/DIG. 10 |
| 3,679,260 | 7/1972 | Morse-Brown . | |
| 4,007,960 | 2/1977 | Gaffney . | |

FOREIGN PATENT DOCUMENTS

| | | |
|---|---|---|
| 0057543 | 8/1982 | European Pat. Off. . |
| 0077280 | 4/1983 | European Pat. Off. . |
| 1150379 | 4/1969 | United Kingdom . |
| 1277210 | 6/1972 | United Kingdom . |
| 1363229 | 8/1974 | United Kingdom . |
| 1453971 | 10/1976 | United Kingdom . |
| 2191683 | 12/1987 | United Kingdom . |
| 2192535 | 1/1988 | United Kingdom . |
| 85/00006 | 1/1985 | World Int. Prop. O. . |

*Primary Examiner*—Francis K. Zugel

*Attorney, Agent, or Firm*—Fleit, Jacobson, Cohn, Price, Holman & Stern

[57] ABSTRACT

An invalid chair (10) has a seat (28) which rises (under spring or other power) at the front (36) as well as at the back (38) to assist the occupant to stand. The seat (28) is mounted by means of a mechanism (30) comprising two pairs of tracks (40,46) on the frame (12) and seat (28) respectively, two pairs of levers (50,62) forming a scissor-like linkage (76) with lever ends (52,64) carrying respective rollers (54,66) running in the tracks (40,46), and torsion springs (78) to provide the force urging the seat (28) upwardly. A latch mechanism (102) is provided to latch the seat (28) down. It can be released by a sitting occupant operating a manual device (114) under one arm (18). When the seat (28) rises, the back (38) rises further than the front (36).

6 Claims, 3 Drawing Sheets

OCCUPANT-ARISING ASSIST CHAIR

BACKGROUND OF THE INVENTION

1. Field of the Invention

This invention relates to a chair. A particular application of the invention is to a chair with a seat which moves from a lowered position to a raised position to at least assist an occupant to rise to a substantially standing position. Such a chair may be of particular benefit to an invalid.

2. Description of the Prior Art

Most, if not all, types of invalid chair have little or no provision for actively assisting an invalid to get out of the chair when desired.

SUMMARY OF THE INVENTION

As seen from one aspect of the invention there is provided a chair comprising a frame and a seat, the seat being mounted for movement between a lowered position and a raised position, the lowered position being suitable for sitting, the chair comprising means for selectively urging the seat from the lowered position to the raised position to at least assist an occupant to rise from a sitting position to a substantially standing position, characterised in that the seat is mounted so that the front of the seat is made to rise as well as, but to a lower height than, the back of the seat when moving from the lowered position to the raised position.

The means for urging the seat from the lowered position to the raised position may be spring means, such as torsional springs, or alternatively may be electric motor means or hydraulic power means.

The seat may be mounted in a variety of ways, but a preferred mounting mechanism comprises a scissor-like linkage formed by pivotally-interconnected levers with rollers engaging two pairs of tracks, one pair on the chair frame and the other pair on the seat itself.

A latch is preferably provided for latching the seat in the lowered position.

The invention will be described by way of example with reference to the accompanying drawings.

DESCRIPTION OF THE PREFERRED EMBODIMENTS

Figure 1:
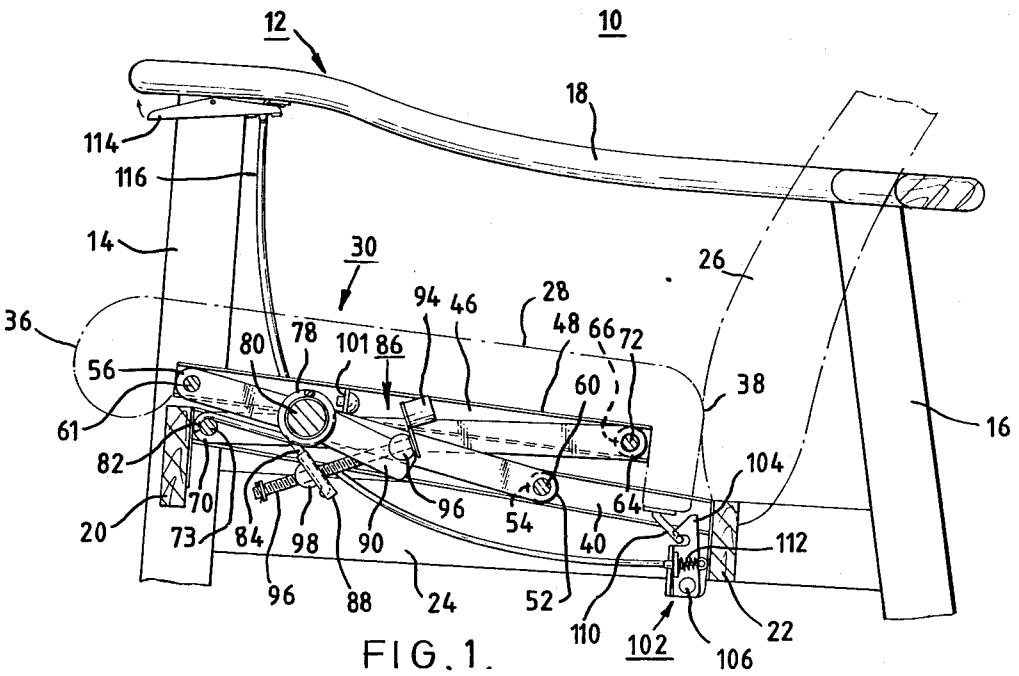
FIG. 1 is a sectional side elevation of a chair embodying the invention, showing the seat (in chain-dot lines) in its lowered position.

The illustrated chair 10 comprises a frame 12 with two front legs 14, two rear legs 16, a pair of arms 18, a front crosspiece 20, a rear crosspiece 22 and two sidepieces 24, connected together as shown. The exact configuration of the frame is not important.

Figure 2:
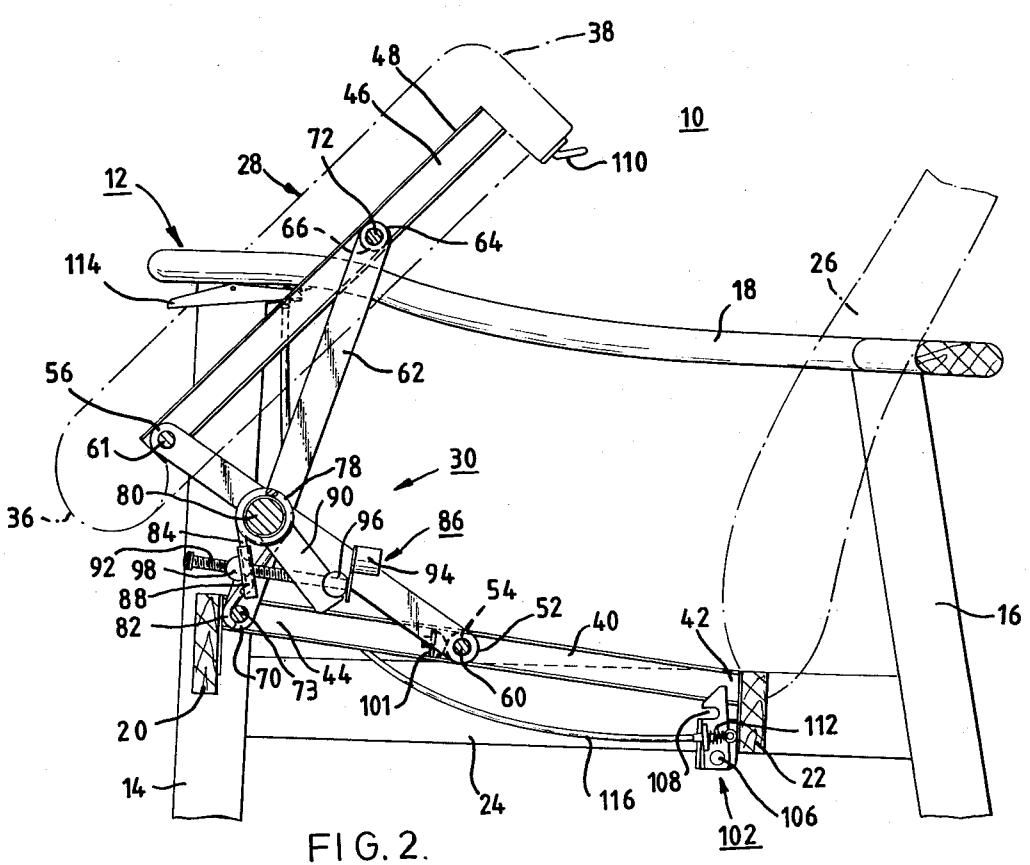
FIG. 2 corresponds to FIG. 1 but showing the seat in its raised position.
Figure 3:
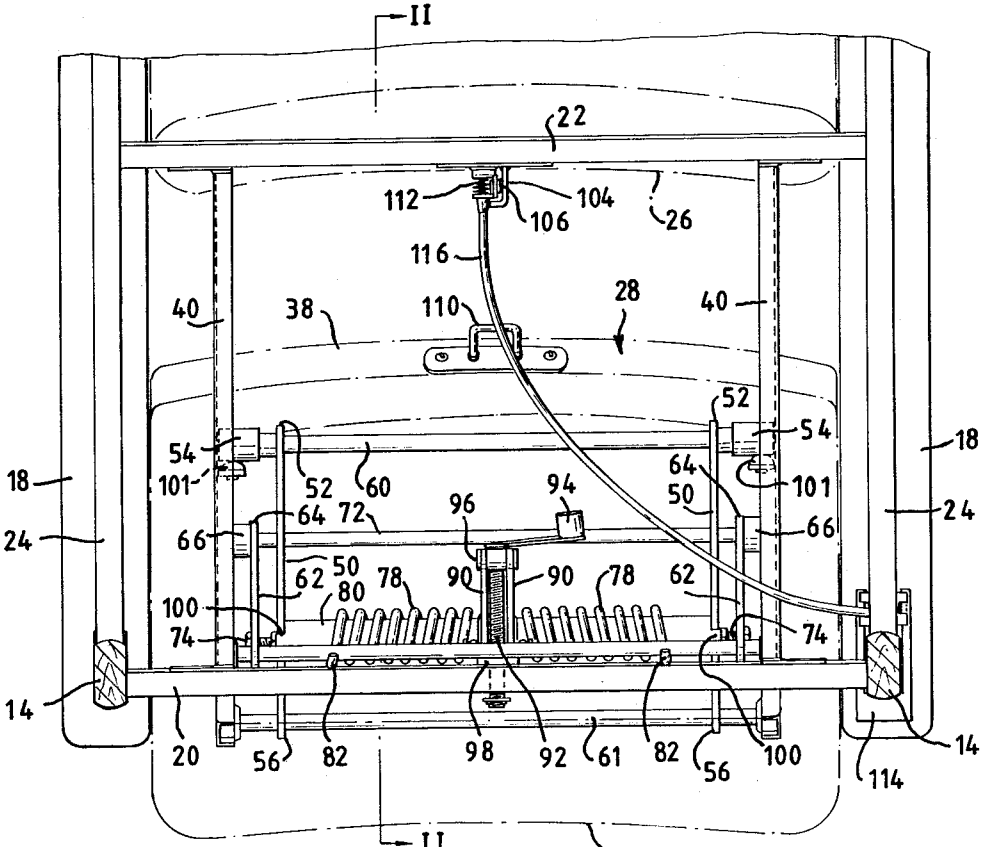
FIG. 3 is an underneath plan view of FIG. 2.

The frame 12 supports a fixed chairback 26 and a movable seat 28. The seat 28 is movable by means of a mechanism 30 between a lowered position, shown in FIG. 1, and a raised position, shown in FIG. 2. The lowered position is the conventional position of a seat for sitting upon. In the raised position, the front 36 of the seat 28 is raised as well as, but to a lower height than, the back 38 of the seat 28.

The mechanism 30 comprises a first pair of rectilinear tracks 40 fixed to the frame 12 near the sides of the frame 12 and extending in the general direction of from the back 42 to the front 44 of the frame 12 (or vice versa) but rising slightly towards the front 44.

The mechanism 30 further comprises a second pair of rectilinear tracks 46 fixed to the underside 48 of the seat 28 near the sides of the seat 28 and extending in the general direction of from the back 38 to the front 36 of the seat 28 (or vice versa).

The mechanism 30 comprises a first pair of levers 50 whose rear or lower ends 52 carry two respective rollers 54 running respectively in the first pair of tracks 40 and whose front or upper ends 56 are pivoted on fixed pivots on the tracks 46 on the underside 48 of the seat 28, near the seat front 36. The rear ends 52 of levers 50 are interconnected by a first cross-rod 60 and the front ends 56 by a fixed second cross-rod 61.

The mechanism 30 also comprises a second pair of levers 62 whose rear or upper ends 64 carry rollers 66 running respectively in the second pair of tracks 46 and whose front or lower ends 68 are pivoted on fixed pivots 70 to the first pair of tracks 40 near the front 44 of frame 12. A third cross-rod 72 interconnects the rear ends 64 of levers 62, whilst a fixed fourth cross-rod 73 interconnects the front ends 68 thereof.

Each first lever 50 is pivoted intermediate its ends 52 and 56 to the adjacent one of the second levers 62 at 74, intermediate the ends 64 and 68 of lever 62, so that the first and second levers 50 and 62 form a scissor-like linkage 76.

To provide force to urge the seat 28 from its lowered position to its raised position, two strong torsion springs 78 are mounted on a cross-shaft 80 which is mounted on the levers 50 and 62 on the axis of the pivots 74. Outer ends 82 of the torsion springs 78 bear on the fixed cross-rod 73, whilst inner ends 84 of springs 78 are torsionally preloaded by means of an adjustment mechanism 86. More particularly, the adjustment mechanism 86 comprises the following parts, namely, a plate member 88 fixed to the inner spring ends 84, a radial bracket 90 welded to the cross-shaft 80, and a screw-threaded bolt 92 having a handle 94 on one end and adjustably interconnecting the plate member 88 (and hence the springs 78) and the radial bracket 90 (and hence the cross-shaft 80). More particularly, the handle end of the bolt 92 is rotatably mounted in a first bolt-anchoring cylindrical piece 96 which is rotatably mounted to the radial bracket 90, whilst the bolt 92 screw-threadedly engages in a second bolt-anchoring cylindrical piece 98 which is rotatably mounted to the plate member 88. Outer ends 100 of the cross-shaft 80 are keyed to one pair of the two pairs of levers 50,62, for example the pair of first levers 50, to prevent rotation of the cross-shaft 80 and hence to prevent unwinding of the torsion springs 78.

The direct effect of the torsion springs 78 is to tend to pivot the second pair of levers 62 upwardly about the fixed pivots 70, by virtue of the spring ends 82 bearing on the fixed cross-rod 73, so that the rear lever ends 64 tend to raise the seat back 38. Because of the scissor-like linkage 76, the front ends 56 of the first levers 50 act to tend to raise the seat front 36, but to a lower height than the seat back 38. Stops 101 limit the forward movement of the rollers 54 in the tracks 40.

A latch mechanism 102 is provided to latch the seat 28 in its lowered position for sitting on. The latch mechanism 102 comprises an upstanding hook member 104, which is pivoted at 106 to the rear crosspiece 22 of the frame 12, and which has a hook 108 directed forwardly to hook onto a ring 110 secured to the seat underside 48 near the seat back 38. A spring 112 biases the hook member 104 forwardly for engaging the ring 110. When the seat 28 is lowered, the ring 110 rides over the top of the hook 108 for automatic engagement thereby.

To release the latch mechanism 102, there is provided a manually operable device 114 fitted to the underside of one of the arms 18 and connected to the latch mechanism 102 by a Bowden cable 116. Operation of the device 114 by a sitting occupant (not shown) causes rearward pivoting of the hook member 104 to release the latch mechanism 102, to allow the springs 78 to urge the seat 28 from its lowered position to its raised position, to at least assist the occupant, and perhaps to propel the occupant, into a substantially standing position.

The latch mechanism 102 cannot be released if nobody is sitting in the chair, unless the seat 28 is pressed downwardly as if it were being sat upon. This is because the torsion springs 78 bias the seat 28 upwardly to the limit of engagement of the ring 110 by the hook 108, and because the top of the hook 108 (where it engages the ring 110) is canted downwardly towards the front so that the ring 110 positively prevents the rearward pivoting of hook member 104.

By sitting on the seat 28, its slight downward movement disengages the ring 110 from the top of the hook 108 to permit rearward pivoting of hook member 104 upon operation of device 114.

I claim:

1. A chair comprising a frame and a seat, the seat being mounted for movement between a lowered position and a raised position, the lowered position being suitable for sitting, the chair comprising means for selectively urging the seat from the lowered position to the raised position to at least assist an occupant to rise from a sitting position to a substantially standing position, characterised in that the seat is mounted so that the front of the seat is made to rise as well as, but to a lower height than, the back of the seat when moving from the lowered position to the raised position, wherein the seat is mounted in the frame by a mechanism including pivotally-interconnected levers having lever arms engaging the frame and seat respectively, and the means for urging the seat includes a spring assembly for urging the lever arms apart, the spring assembly including a first transverse shaft extending from one of said lever arms, a second transverse shaft extending from the other of said lever arms, a helical torsion-spring surrounding the first shaft, the torsion-spring having first and second ends, the first end engaging the second shaft, the first shaft having a radially extending bracket and an adjustment screw connected between the bracket and a plate secured to the second end of the spring for adjustably pre-loading the spring so as to vary the force exerted on the seat by the spring, the force of the spring urging the seat toward the raised position and the chair including a releasable latch on the frame for engaging a part of said mechanism when the lever arms are pressed toward one another against the force of the spring to releasably hold the seat in the lowered position.

2. A chair as claimed in claim 1 wherein the levers each have respective track-engaging roller means which engage in tracks on the seat and frame respectively.

3. A chair as claimed in claim 2, wherein said levers form a scissor-like mechanism.

4. A chair as claimed in claim 1 wherein the latch is non-releasable except with the seat subjected to a downward force as by the weight of an occupant.

5. A chair as claimed in claim 4 wherein means responsive to the seat being in the lowered position is adapted to alter the disposition of the latch to permit release of the latch when the seat is subjected to said downward force.

6. A chair as claimed in claim 4 wherein the latch comprises a pivotal lever with a canted surface for engaging said part of the mechanism and preventing release of the latch when the weight of an occupant is not present on the seat, said part of the mechanism being disengaged from said surface when the weight of the occupant is present on the seat.

* * * * *